US007161100B1

(12) United States Patent
Hsieh

(10) Patent No.: US 7,161,100 B1
(45) Date of Patent: Jan. 9, 2007

(54) LIMIT SWITCH MECHANISM FOR DOOR OPENING

(76) Inventor: Chung-Hsien Hsieh, 116 Fen Liao Road, Sec. 1, Lin-Kou Hsiang, Taipei Hsien (TW)

( * ) Notice: Subject to any disclaimer, the term of this patent is extended or adjusted under 35 U.S.C. 154(b) by 0 days.

(21) Appl. No.: 11/398,429

(22) Filed: Apr. 5, 2006

(51) Int. Cl.
*H01H 3/16* (2006.01)

(52) U.S. Cl. ..... 200/47

(58) Field of Classification Search ..... 200/33 C, 200/33 D, 33 B, 47, 500, 501, 542, 573; 74/89.37, 89.15; 192/141, 143
See application file for complete search history.

(56) References Cited

U.S. PATENT DOCUMENTS 2,951,920 A * 9/1960 Miller ..... 200/47
2,964,601 A * 12/1960 Stockwell ..... 200/47
3,676,625 A * 7/1972 Blatt ..... 200/542
3,715,530 A * 2/1973 Dalton ..... 200/47
3,825,809 A * 7/1974 Gatland et al. ..... 200/47
4,247,744 A * 1/1981 Birkle ..... 200/47
4,829,148 A * 5/1989 Muller ..... 200/47
5,299,678 A 4/1994 Chang et al.
5,579,899 A * 12/1996 Arnold ..... 200/47
5,890,585 A * 4/1999 Nakamura et al. ..... 200/47
6,321,611 B1 * 11/2001 Szu et al. ..... 200/47

* cited by examiner

*Primary Examiner*—Michael A Friedhofer
(74) *Attorney, Agent, or Firm*—Buckham & Archer

(57) ABSTRACT

An improved limit switch mechanism is provided in which it includes a plurality of cassettes of limit switch subassembly, each cassette containing: a limit switch mounting bracket, a first limit switch and a second limit switch fastened onto said limit switch mounting bracket by screws; the deflection direction of the control lever of each limit switch being directed radially towards the center of the concerned switch actuator when each cassette of limit switch subassembly is inserted and fixed in a pair of slits, which is inclined at certain angle relative to horizontal direction and provided on opposite side walls of the base frame. Accordingly, positive actuation on control lever of each limit switch and long service life of each limit switch can be achieved.

4 Claims, 4 Drawing Sheets

LIMIT SWITCH MECHANISM FOR DOOR OPENING

FIELD OF THE INVENTION

This invention relates to a limit switch mechanism for door use, especially to an improved limit switch mechanism, which can achieve positive actuation on control lever of each limit switch and long service life of each limit switch actuator as well as each limit switch.

DESCRIPTION OF THE PRIOR ART

Generally, a limit switch mechanism is used to control the electric motor for door opening and closing. In addition to the basic adjustment of the upper and lower limit of door stroke to match discrete door structure, another demands such as safety demand, which is necessary to control the movement of the door when an object is encountered, remote control demand, open/close status information providing demand are also requested in some cases. In U.S. Pat. No. 5,299,678, a limit switch mechanism for garage door control is disclosed.

Referring to FIG. 1, a brief description of said prior art will be made. The limit switch mechanism 10 comprises a frame 12 having a bottom portion 12*a* and side walls 12*b*. A shaft 28 extending through the sidewall 12*b* of the frame 12 at a location where journal bearings are provided to mount the shaft 28 for rotation with point $O_r$ as the center, and having a threaded portion 28*b*, engages with two switch actuators 32 and 34 received thereon. Limit switches 36, 38, 40 and 42 are provided respectively with flexible control levers 36*a*,38*a*,40*a*,42*a*, which actuate their respective limit switches when deflected. The control levers are positioned in the path of the switch actuators 32 and 34. It is noted that the limit switches 36,38,40 and 42 are mounted on the bottom portion 12*a* in such manner that their respective control levers 36*a*, 38*a*, 40*a* and 42*a* is deflected in horizontal direction when actuated by the switch actuators 32 or 34.

In order for the switch actuator 32 and 34 to engage the various switch control lever 36*a*, 38*a*, 40*a* and 42*a* at a selected point in time with respect to stroke of door travel, the switch actuator 32 and 34 is rotated with respect to the shaft 28 so as to move the switch actuator 32 and 34 axially along the shaft 28. After the adjustment has been accomplished, a latch means 46 is used to limit the rotation of the switch actuator 32 and 34. The switch actuator restraining edge 48*a* of a plate 48 of the latch means 46 is normally biased, by a torsion spring 52, to engage in one of the radially extending slots 32*c* and 34*c* formed on the switch actuator 32 and 34 to restrain relative rotation with respect to the shaft 28. When it becomes necessary to adjust the location of the switch actuators 32 and 34, the plate 48 is simply pressed by human finger in a manner that the restraining edge 48*a* is disengaged from the slots 32*c* and 34. After the adjustment has been finished, the plate 48 is released to let the restraining edge 48*a* engaged with slots 32 and 34.

However, this conventional has problem. As mentioned before, four limit switches 36, 38, 40 and 42 are supported on the bottom portion 12*a* in such manner that their respective control levers 36*a*, 38*a*, 40*a* and 42*a* are deflected in horizontal direction when actuated by the switch actuators 32 and 34. This is to say that the force acted from the switch actuators 32 and 34 on respective control levers 36*a*, 38*a*, 40*a* and 42*a* is not aligned with the direction of moving of the control levers. The force component in coincidence to the direction of deflection is effective to ensure positive actuation of each control lever on respective switch. However, the force component normal to the direction of deflection of the control levers will apply unnecessary stress on the control levers, which tends to cause unstable in the action of the control lever. What is more, these normal force component causes serious wear on the periphery of the switch actuators 32 and 34 and the control levers. Thus, this will cause unnecessary reduction on service life of the limit switch mechanism.

Furthermore, in some cases the number of limit switch provided within limit switch mechanism should be increased to provided open/close status signal, for safety switch use, and for remote control purpose, and for possible particular use in the future, in addition to the basic demand of adjustment of the upper and lower limit of door stroke to match discrete door structure. For example, the number of limit switches illustrated in figures is 6. However, the type of the arrangement in conventional design, horizontal disposition, often fails to meet this requirement, due to the space limitation.

Therefore, it is the main object of this invention to provide an improved limit switch mechanism which can provide positive actuation of the control lever of limit switch at the time of engagement with limit switch actuator, and which provides longer service life for limit switch in comparison to the conventional limit switch mechanism.

It is another object of this invention to provide an improved limit switch mechanism which can provide sufficient number of limit switches required for various control or monitoring purpose.

SUMMARY OF THE INVENTION

In order to achieve the above object, this invention provides a limit switch mechanism for controlling the operation of a motor over a selected range of movement, comprising:

A base frame, having two end walls opposite to each other with a plurality of oblique slit pairs arranged opposite to each other, and a bottom plate;

a shaft journaled at end walls of said base frame for rotational movement, said shaft being threaded between said journaled ends;

a first switch actuator and a second switch actuator threadedly received on said shaft, each switch actuator being generally cylindrical with an axially extending threaded bore and being formed with a plurality of radially extending slots equally spaced around the periphery;

a plurality of cassettes of limit switch subassembly, each containing: a limit switch mounting bracket, a first limit switch and a second limit switch fastened onto said limit switch mounting bracket by suitable screw means, each cassette being inserted and fixed in said pair of opposite slits, each said limit switch having control means operating one of said limit switches, said control means for said first limit switch being positioned in the path of said first switch actuator to operate said first limit switch upon axial movement of said first switch actuator toward one of said shaft ends, said control means for said second limit switch actuator being positioned in the path of said second switch actuator to operate said second limit switch upon axial movement of said second switch actuator toward the other of said shaft ends;

latch means, biased into engagement with said first switch actuator and said second switch actuator for engaging said slots to restrain rotation of said switch actuators while permitting axial movement of said switch actuators along said shaft upon shaft rotation, and manually actuatuable for an operator to readily disengage the latch function of restraining rotation of said switch actuators, wherein each said oblique slit is inclined at an angle such that said control means of each limit switch is directed radially towards the center of the concerned switch actuator, when each cassette of limit switch subassembly is inserted and fixed in a pair of slit on the opposite end walls of said base frame.

The base frame of the limit switch mechanism further includes two punched-up portions on the bottom plate, said punched-up portions on the bottom plate being inclined at an angle such that said control means of each limit switch is directed radially towards the center of the concerned switch actuator, when each limit switch is fixed on said two punched-up portions of said base frame.

The above and the other objects and merits of this invention will become more apparent by the detailed description of an embodiment in reference to the accompanied drawings, in which:

BRIEF DESCRIPTION OF ACCOMPANIED DRAWINGS

Figure 1:
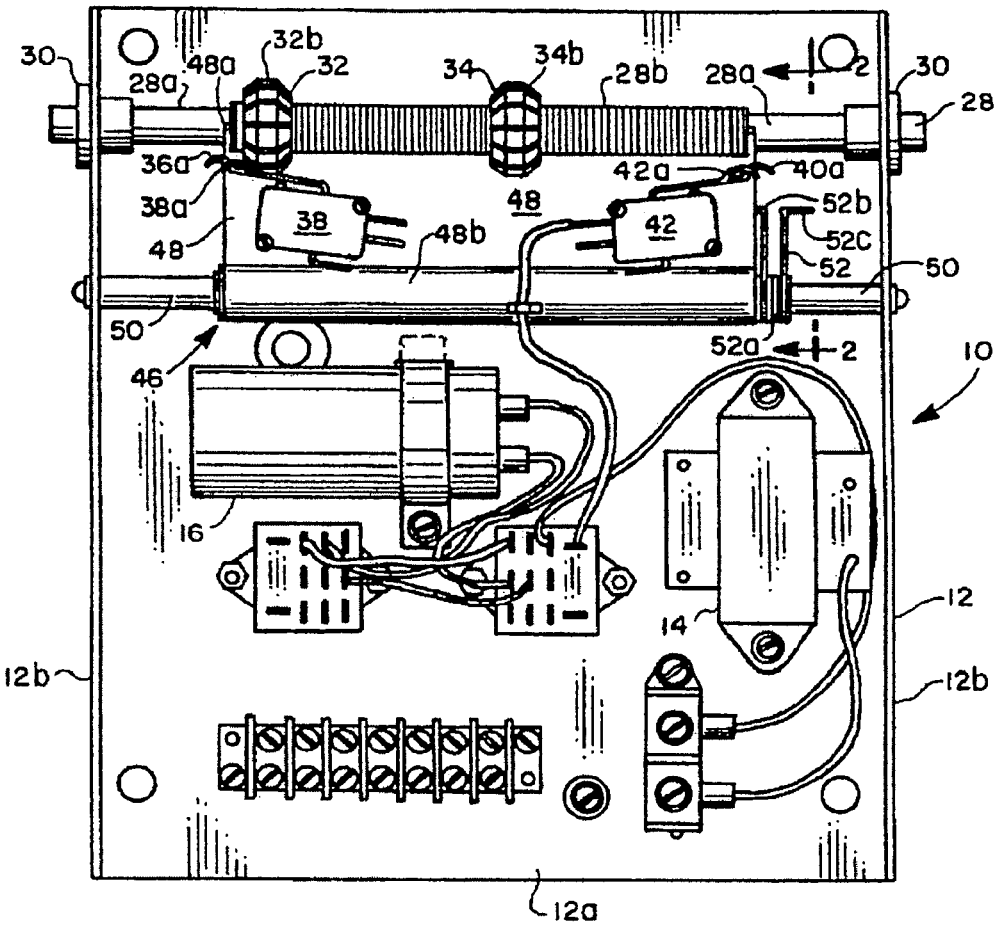
( PRIOR ART ) FIG. 1
FIG. 1 is a top view showing a conventional limit switch mechanism.
Figure 2:
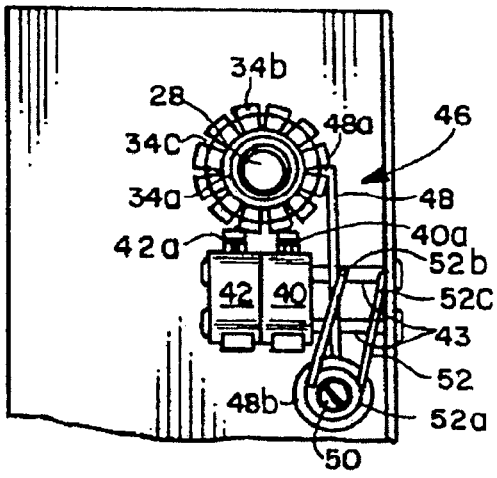
( PRIOR ART ) FIG. 2
FIG. 2 is a partial sectional view taken on line 2—2 of FIG. 1 showing the latch mechanism of a conventional limit switch mechanism.
Figure 3A:
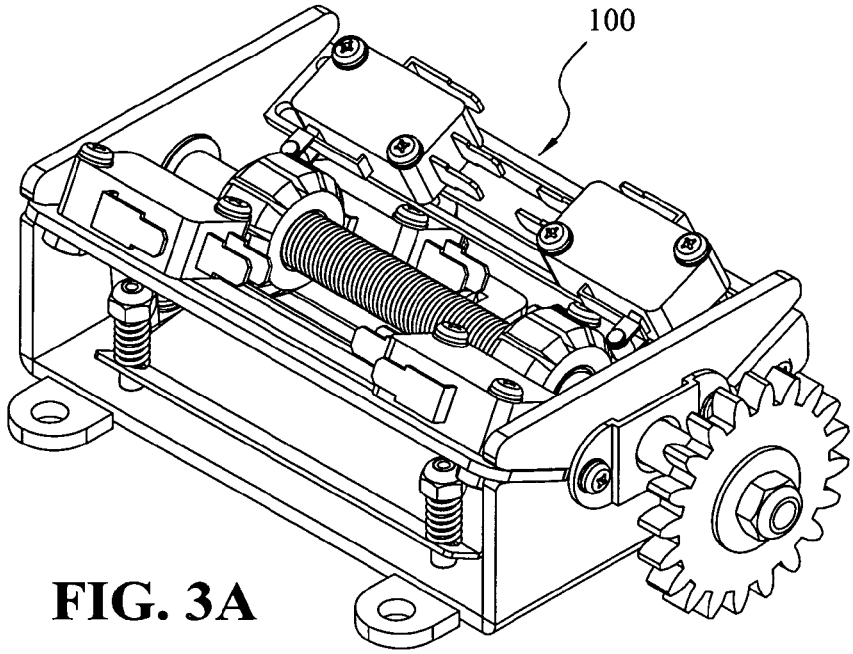

FIG. 3*a* is a schematically perspective view of the limit switch mechanism of the present invention.

Figure 3B:
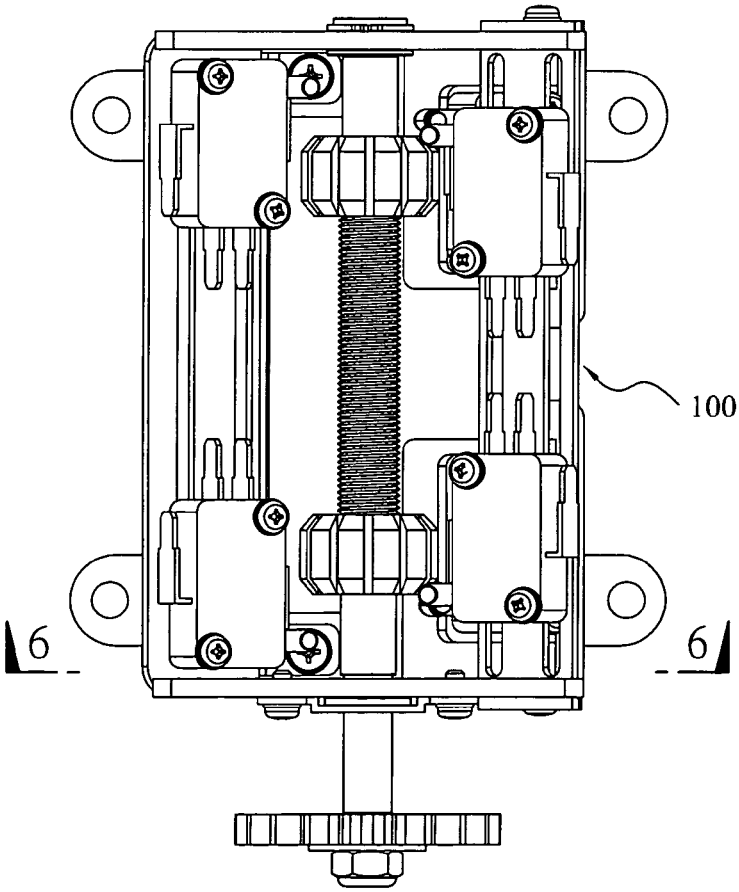

FIG. 3*b* is a top view of the limit switch mechanism of the present invention.

Figure 4:
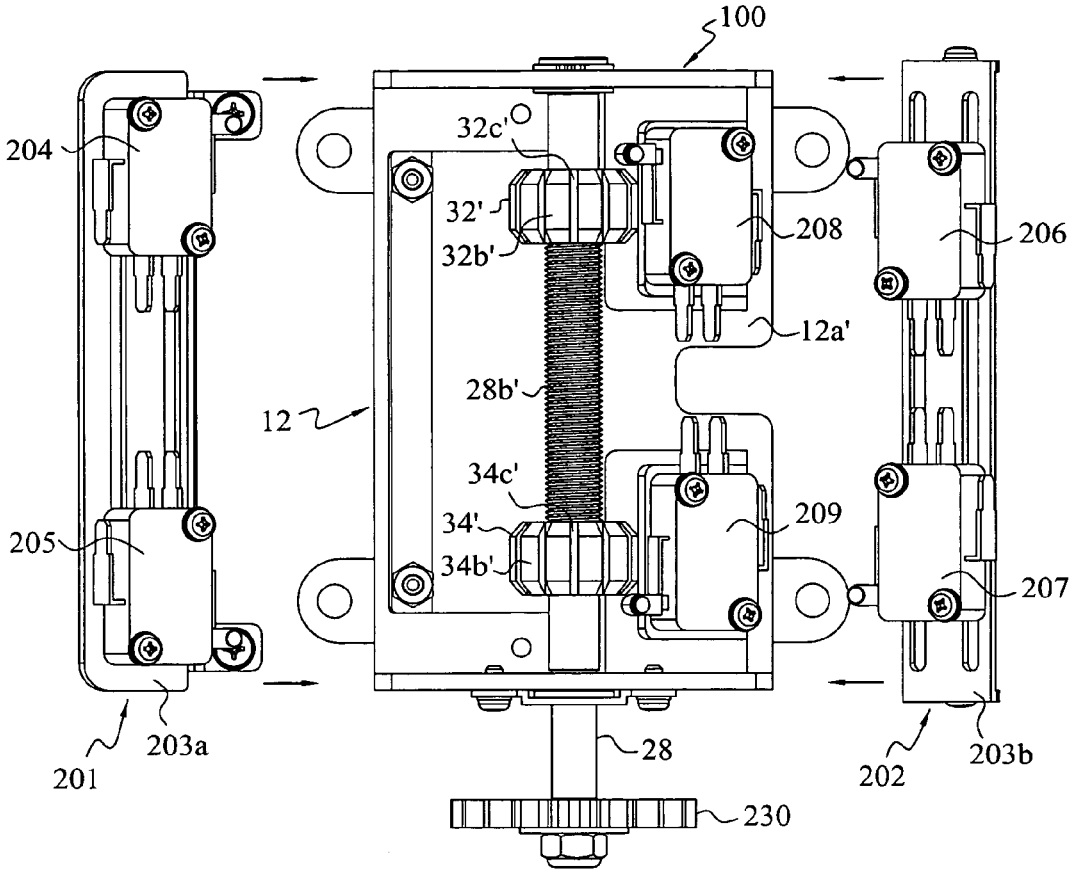

FIG. 4 is a top view of the limit switch mechanism showing the status before the assembly of the cassette of limit switch subassembly to the limit switch mechanism body.

Figure 5:
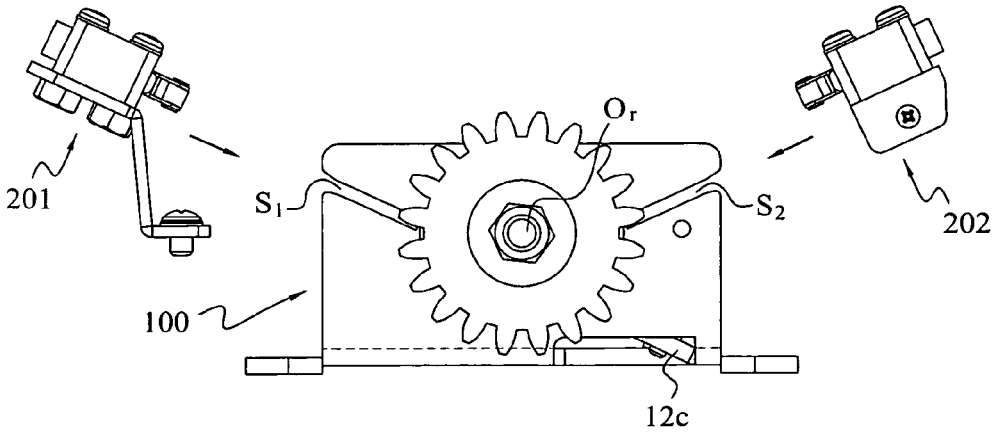

FIG. 5 is an elevational view of the limit switch mechanism shown in FIG. 4.

Figure 6:
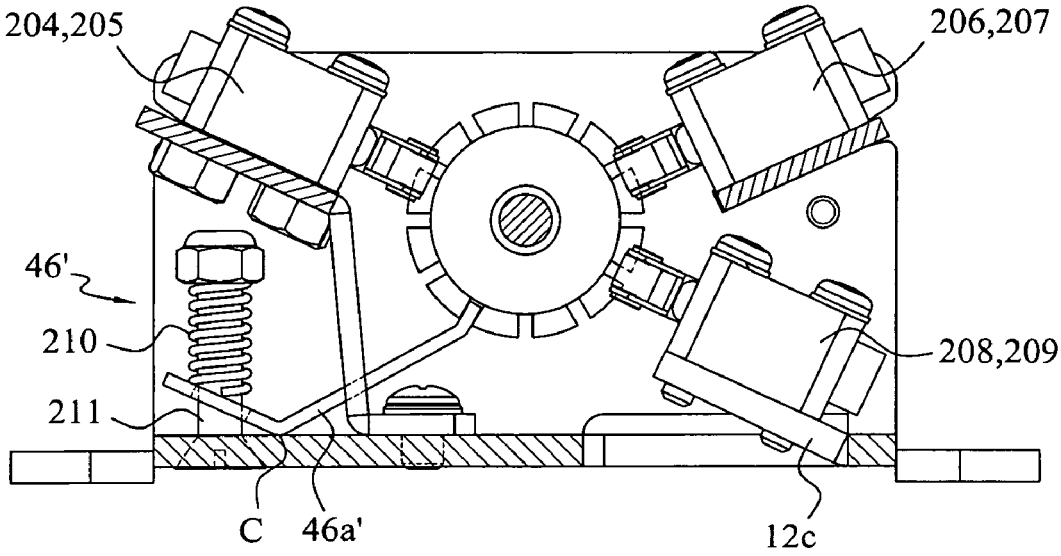

FIG. 6 is a cross-sectional view taken alone line 6—6 of FIG. 3*b*.

Figure 7:
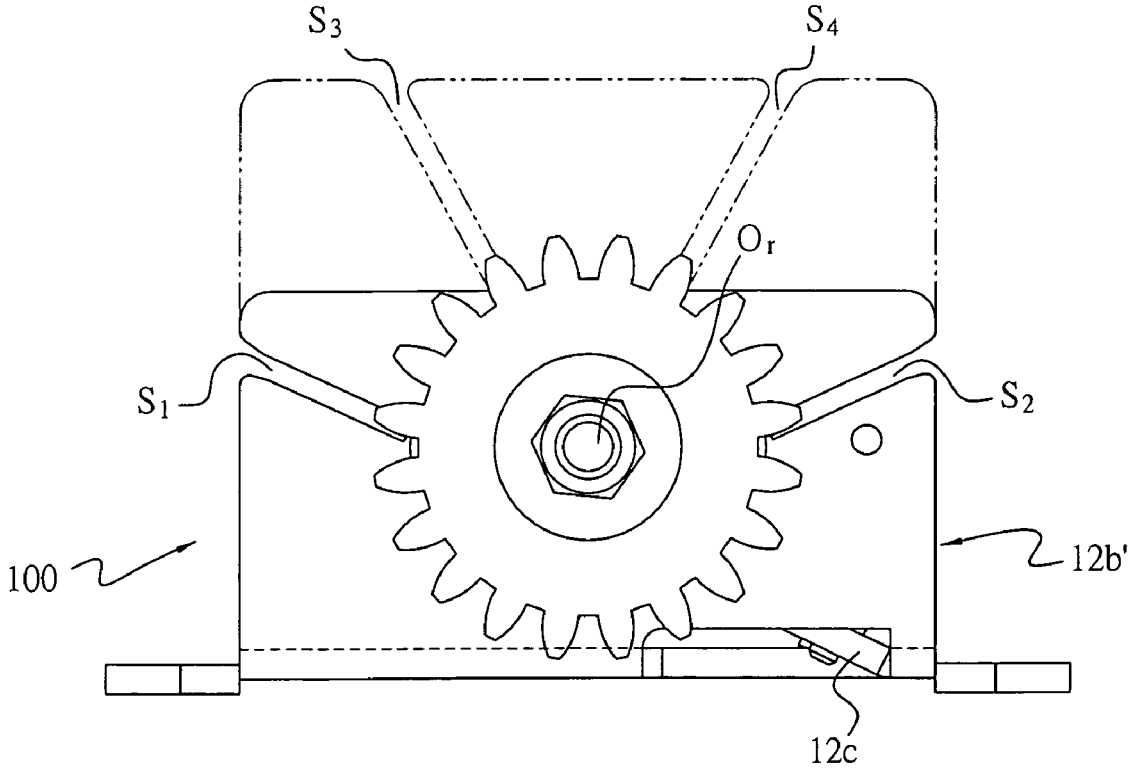

FIG. 7 shows another embodiment of the base frame with different height.

DETAILED DESCRIPTION OF A PREFERRED EMBODIMENT

Referring to the FIGS. 3~6, a limit switch mechanism of the present invention is designated generally by the reference number 100. As shown in FIG. 4, the limit switch mechanism 100 has a base frame 12' having a bottom plate 12*a*' and sidewalls 12*b*'. A shaft 28' is shown extending through the sidewalls 12*b*' of the base frame 12' at location $O_r$ where journal bearings are provided to mount the shaft 28' for rotation with point $O_r$ as the center, and having a threaded portion 28*b*' which engages with two switch actuators 32' and 34' received thereon. Switch actuators 32' and 34' are identical in size and shape, in which the peripheral portions 32*b*' and 34*b*' are formed with radially extending slots 32*c*' and 34*c*'.

The shaft 28' is driven by the engagement of a gear 230, fixed at the end of the shaft 28', with a gear (not shown) mounted on the output shaft of a driving motor (not shown).

As shown in FIG. 4, two cassettes 201, 202 of limit switch subassembly are ready to insert into the slits on the side walls 12*b*'. The cassette 201 includes a limit switch mounting bracket 203*a*, and two limit switches 204, 205 fixed on said bracket 203*a* by screws. The cassette 202 includes a limit switch mounting bracket 203*b*, and two limit switches 206, 207 fixed on said bracket 203*a* by screws. After the insertion into slits S1 on both sidewalls 12*b*', the cassette of limit switch subassembly 201 is fixed onto the bottom plate 12*a* by screw. Similarly, after the insertion into slits S2 on both sidewalls 12*b*', the cassette of limit switch subassembly 202 is fixed onto the bottom plate 12*a* by screw. Round holes for the passing through of assembly bolts can be provided on the limit switch mounting bracket 203*a*, 203*b*. In this case, limit switch is fixedly mounted relative to the mounting bracket. Alternatively, elongated slots instead of round holes can be provided on any limit switch-mounting bracket. In this case, limit switch can be adjustably mounted relative to the mounting bracket.

As shown in FIG. 4, the slits on the side walls 12*b*' of the base frame 12' is ready for the insertion of the cassette of limit switch subassembly 201, 202. Each slit is inclined at an angle such that the deflection direction of the control lever of each limit switch is directed radially towards the center $O_r$ of the concerned switch actuator 32', 34', when each cassette of limit switch subassembly is inserted and fixed in a pair of slit on the opposite end walls 12*b*' of said base frame 12'.

The base frame 12' further includes two punched-up portions 12*c* on the bottom plate 12*a*'. Limit switches 208, 209 are fixedly mounted on the punched-up portions 12*c* respectively. The punched-up portions 12*c* on the bottom plate 12*a*' are inclined at same angle such that the deflection direction of the control lever of each limit switch is directed radially towards the center $O_r$ of the concerned switch actuator 32', 34', when each limit switch 208, 209 is fixed on said two punched-up portions 12*c* of the base frame 12'.

As mentioned above, since the deflection direction of the control lever of each limit switch 204~209 is directed forward to the center $O_r$, the force acted on the control lever by the limit switch actuator is completely aligned with the deflection direction of the control lever. No force component in the tangential direction at the point of contact, which contributes to the warp and wear of the control lever as well as the switch actuator 32', 34' during contact, is occurred. In comparison with the conventional limit switch mechanism, the service life of the limit switch and the switch actuator of this invention becomes relatively longer which results in long service life and high reliability of limit switch.

The switch actuators 32', 34' can be rotated to move axially along the shaft 28', so that they can engage various switch control levers (in this case, 6) at selected point corresponding to the travel height of door. After the positional adjustment of the switch actuators 32', 34' is completed, a latch means 46' is used to limit the rotation of the switch actuators 32', 34' with respect to the shaft 28'. As shown in FIG. 6, the latch means 46' includes a latch member 46*a*' and a biased spring 210. One end of the latch member 46*a*' has a tip portion T, which is used for the engagement with the slots 32*c*', 34*c*' on the switch actuators 32', 34', the other end has and two holes passing through by the bolts 211 and biased by the torsion spring 210. In spring-biased condition, the tip portion T is engaged with a slot on concerned switch actuator. In case that an adjustment is needed, the latch member 46*a*' is pressed by a human finger to disengage the tip portion T from the slot, so that the switch actuator 32' or 34' is rotated to move axially on the shaft 28' for the adjustment.

The number of limit switch in the above embodiment is 6, however, this invention is not limited by this case. As shown in FIG. 7, another embodiment of the base frame 12" is shown with different height. In addition to the slits S1 and S2, 2 more slits S3 and S4 are provided on the upper portion of sidewall 12*b*. As mentioned above, the slit S3 and S4 are also inclined at an angle such that the deflection direction of the control lever of each limit switch is directed radially towards the center $O_r$ of the concerned switch actuator 32' or 34', when each cassette of limit switch subassembly is inserted and fixed in a pair of slit on the opposite end walls 12*b*' of said base frame 12". In this case, the number of limit switch can be increased up to 10.

The invention claimed is:

1. A limit switch mechanism for controlling the operation of a motor over a selected range of movement, comprising:

A base frame, having two end walls opposite to each other with a plurality of oblique slit pairs arranged opposite to each other, and a bottom plate;

a shaft journaled at the end walls of said base frame for rotational movement, said shaft being threaded between said journaled ends;

a first switch actuator and a second switch actuator threadedly received on said shaft, each of the switch actuators being generally cylindrical with an axially extending threaded bore and being formed with a plurality of radially extending slots equally spaced around the periphery;

a plurality of cassettes of limit switch subassemblies, each of the cassettes containing: a limit switch mounting bracket, a first limit switch and a second limit switch fastened onto said limit switch mounting bracket by suitable screw means, each of the cassettes cassette being inserted and fixed in said pair of opposite slits, each of said limit switches having control means operating one of said limit switches, said control means for said first limit switch being positioned in the path of said first switch actuator to operate said first limit switch upon axial movement of said first switch actuator toward one of said shaft ends, said control means for said second limit switch actuator being positioned in the path of said second switch actuator to operate said second limit switch upon axial movement of said second switch actuator toward the other of said shaft ends;

latch means, biased into engagement with said first switch actuator and said second switch actuator for engaging said slots to restrain rotation of said switch actuators while permitting axial movement of said switch actuators along said shaft upon shaft rotation, and manually actuatuable for an operator to readily disengage the latch function of restraining rotation of said switch actuators, wherein each of said oblique slits is inclined at an angle such that the deflection direction of said control means of each of the limit switches is directed radially towards the center of the concerned switch actuator, when each of the cassettes of the limit switch subassemblies is inserted and fixed in a pair of the slits on the opposite end walls of said base frame.

2. A limit switch mechanism as claimed in claim 1, wherein said base frame further includes two punched-up portions on the bottom plate, said punched-up portions on the bottom plate being inclined at an angle such that the deflection direction of said control means of each of the limit switches is directed radially towards the center of the concerned switch actuator, when each of the limit switches is fixed on said two punched-up portions of said base frame.

3. A limit switch mechanism as claimed in claim 1, wherein the number of the limit switches received therein is 6.

4. A limit switch mechanism as claimed in claim 1, wherein the number of the limit switches received therein is 10.

* * * * *